US011583472B1

(12) United States Patent
Myers-Ramsay

(10) Patent No.: US 11,583,472 B1
(45) Date of Patent: Feb. 21, 2023

(54) SPA SYSTEM

(71) Applicant: Carrol Myers-Ramsay, Greenacres, FL (US)

(72) Inventor: Carrol Myers-Ramsay, Greenacres, FL (US)

( * ) Notice: Subject to any disclaimer, the term of this patent is extended or adjusted under 35 U.S.C. 154(b) by 373 days.

(21) Appl. No.: 16/807,238

(22) Filed: Mar. 3, 2020

(51) Int. Cl.
*A61H 33/00* (2006.01)
*A45D 29/00* (2006.01)
*A61H 35/00* (2006.01)

(52) U.S. Cl.
CPC ..... *A61H 33/0091* (2013.01); *A45D 29/00* (2013.01); *A61H 35/00* (2013.01); *A61H 2201/0149* (2013.01); *A61H 2201/0157* (2013.01); *A61H 2201/1635* (2013.01)

(58) Field of Classification Search
CPC ..... A61H 33/0091; A61H 35/00; A61H 2201/0149; A61H 2201/0157; A61H 2201/1635; A45D 29/00
USPC ..... 4/621, 619, 571; 297/180.1, 217.1
See application file for complete search history.

(56) References Cited

U.S. PATENT DOCUMENTS 3,678,943 A 7/1972 Noel et al.
5,459,887 A * 10/1995 Roman ..... A61H 33/6073 4/574.1
5,947,131 A 9/1999 Kim
D736,022 S * 8/2015 Vo ..... D6/716.3
D909,111 S * 2/2021 Jan ..... D6/338
2005/0067866 A1* 3/2005 Luong ..... A47C 1/11 297/217.3
2009/0230738 A1* 9/2009 Le ..... A47C 7/727 297/217.4
2011/0010837 A1* 1/2011 Ton ..... A47C 16/025 297/423.46
2013/0019394 A1* 1/2013 Tran ..... A47C 15/00 4/590
2015/0075575 A1* 3/2015 Karlovich ..... A61N 1/0452 135/65
2017/0258679 A1* 9/2017 Drozdov ..... A47C 1/06
2020/0040561 A1* 2/2020 Sugawara ..... A47K 17/026
2020/0307436 A1* 10/2020 Powell ..... B60R 15/02
2021/0017060 A1* 1/2021 Kalp ..... A01K 63/045
2022/0218564 A1* 7/2022 Le ..... A61H 35/006

* cited by examiner

*Primary Examiner* — Lori L Baker
(74) *Attorney, Agent, or Firm* — Sanchelima & Associates, P.A.; Christian Sanchelima; Jesus Sanchelima

(57) ABSTRACT

A spa system having a chair attachment and a tabletop device. The chair attachment includes a receptacle which is removably attachable to a chair which has a motor for providing bubble treatments. The receptable includes a housing attachment having water jets to provide a spa treatment to a user. Further, the receptacle allows for a user to submerge their entire hand within water located in the receptacle. Additionally, the tabletop device is mounted onto a table to then aid in providing spa treatment for a user. Each device contains a compartment that is attachable to the side of the device which contains various utensils to aid a user in a manicure.

9 Claims, 5 Drawing Sheets

SPA SYSTEM

BACKGROUND OF THE INVENTION

1. Field of the Invention

The present invention relates to a spa system and, more particularly, to a spa system that that includes a spa device that attaches to an armchair and a spa device mounted onto a table, both devices allow for a user to submerge their hands entirely within the water.

2. Description of the Related Art

Several designs for a spa device have been designed in the past. None of them, however, include a device for providing treatments comprising a receptacle which is removably attachable to a chair which has a motor for providing bubble treatments. The receptable includes a housing attachment having water jets to provide a spa treatment to a user. Further, the receptacle allows for a user to submerge their entire hand within water located in the receptacle. Additionally, the invention includes a spa device that is mounted onto a table to then aid in providing spa treatment for a user. Each device contains a compartment that is attachable to the side of the device which contains various utensils to aid a user in a manicure. The spa device for the table includes a removable tray that provides a comfortable platform for a user to rest their hands on when receiving a spa treatment. It is known that users that receive spa treatments often have the desire to submerge their hands entirely within water to aid in the spa treatment. Therefore, there is a need for a flexible spa system that allows a user receiving a spa treatment to entirely submerge their hands in water. The present invention provides a chair attachment and a tabletop device to provide a user the flexibility of having a spa treatment in their most comfortable position.

Applicant believes that a related reference corresponds to U.S. Pat. No. 3,678,943 issued for a portable hair washing coloring unit, that is attachable to a chair. Applicant believes that another related reference corresponds to U.S. Pat. No. 5,947,131 issued for a nail tip removal apparatus that includes a cup for holding nail tip removal solution. However, these references differ from the present invention because they fail to address the issue of having a spa system that provides treatment to a user's hands. Additionally, the references fail to provide the flexibility of being able to receive a spa treatment at a chair or a tabletop. The references further fail to teach of a spa device that allows a user to entirely submerge their hands in water when receiving a spa treatment. The present invention provides a spa treatment system that collectively addresses all these issues.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide spa system that provides an effective manicure device for nail salons and consumer use.

It is another object of this invention to provide a spa system that ensures that manicure tools and accessories are easily accessible.

It is still another object of the present invention to provide a spa system having a chair attachment that attaches to the armrest of a chair, the chair attachment provides bucket section that allows a user to entirely submerge their hands in water to soften the user's cuticles.

It is still another object of the present invention to provide a spa system having a tabletop device to aid in providing a user an effective spa treatment allowing the user to submerge their entire hand in water.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
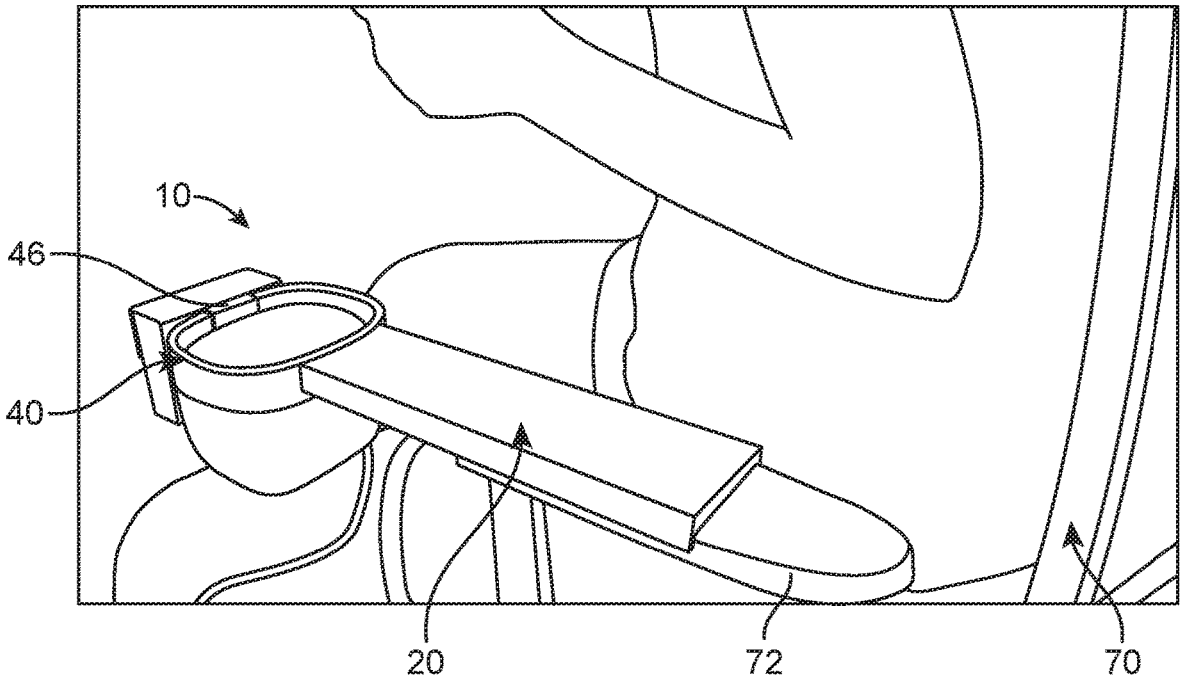
FIG. 1 represents an isometric view of chair attachment assembly 20 of spa system 10 in an operating environment in accordance to an embodiment of the resent invention.
Figure 2:
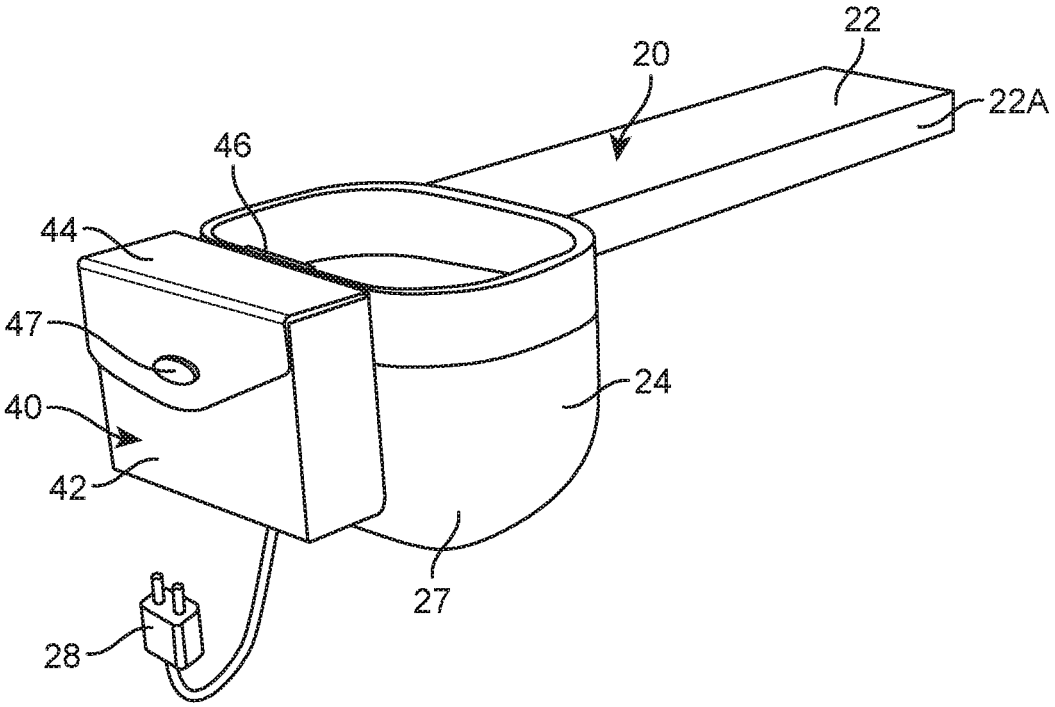
FIG. 2 shows an isometric view of chair attachment assembly 20 in accordance to an embodiment of the present invention.
Figure 3:
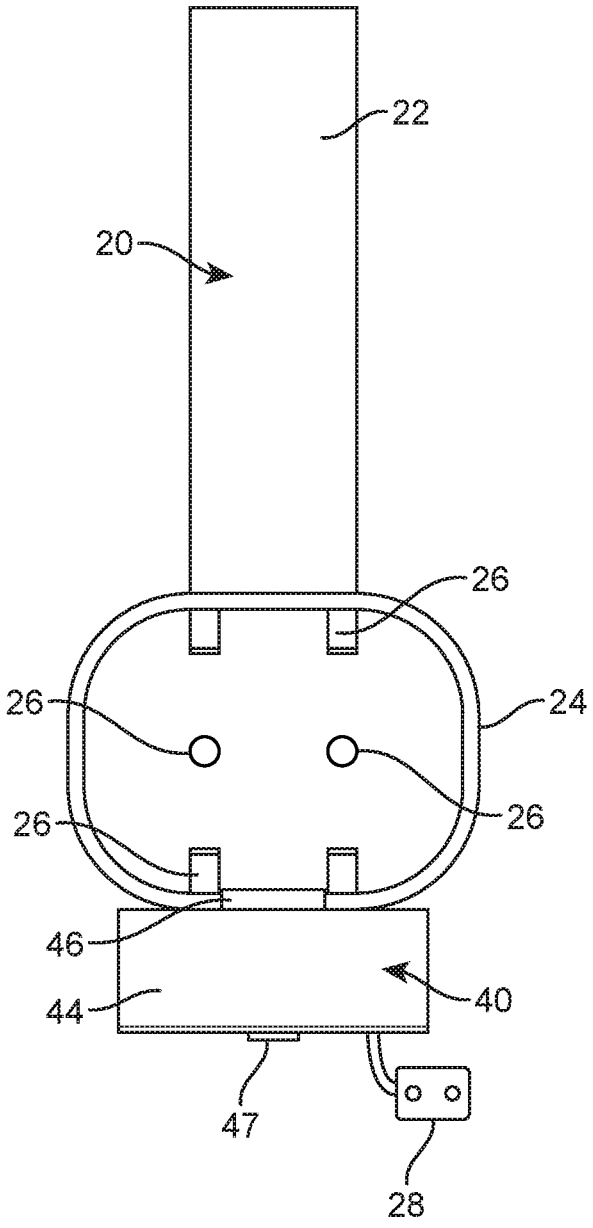
FIG. 3 illustrates a top view of view of chair attachment assembly 20 in accordance to an embodiment of the present invention.
Figure 4:
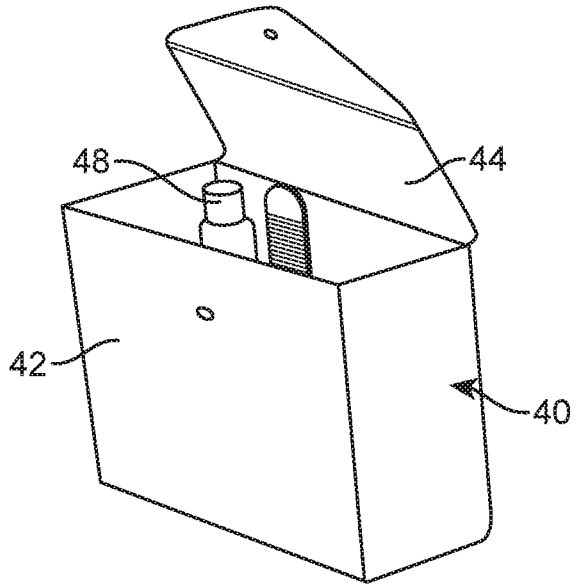
FIG. 4 is a representation of an enlarged view of compartment assembly 40 in an open position accordance to an embodiment of the present invention.
Figure 5:
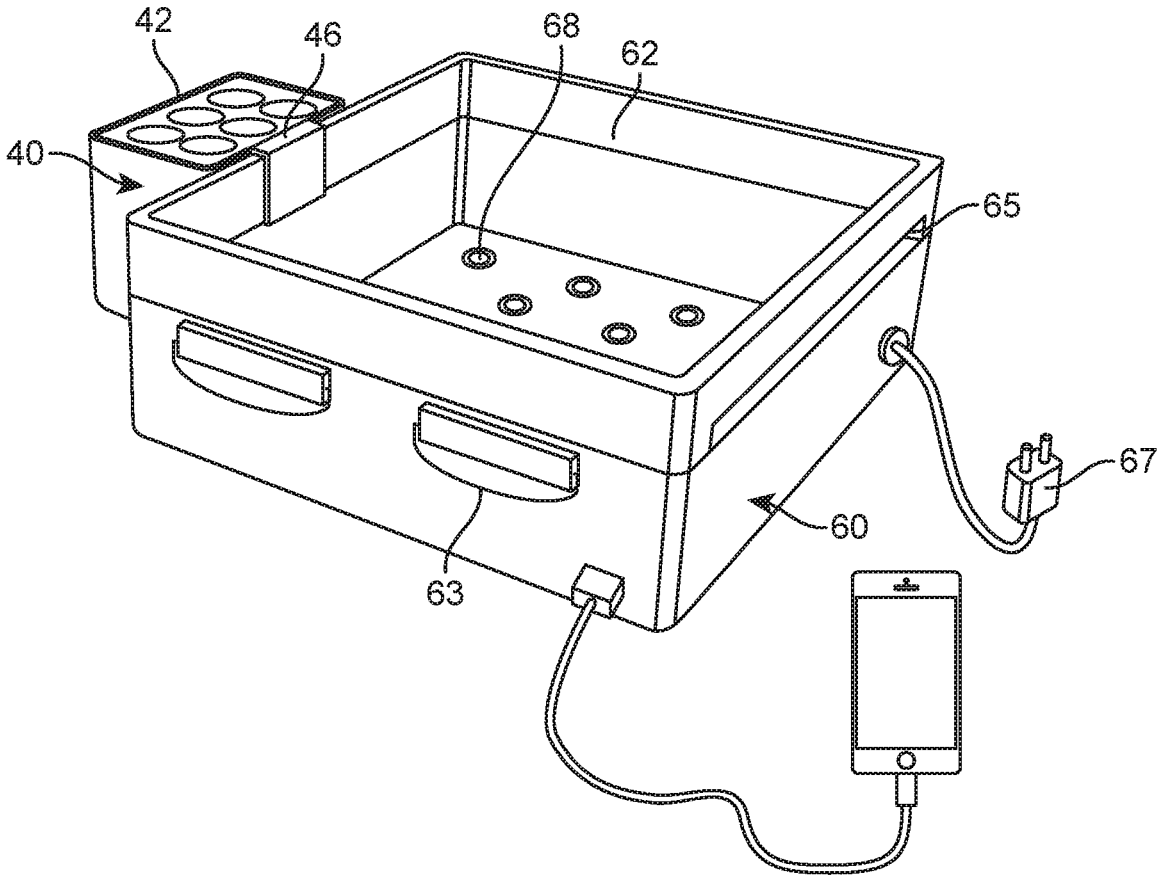
FIG. 5 is a representation of an isometric view of tabletop device assembly 60 in accordance to an embodiment of the present invention.
Figure 6:
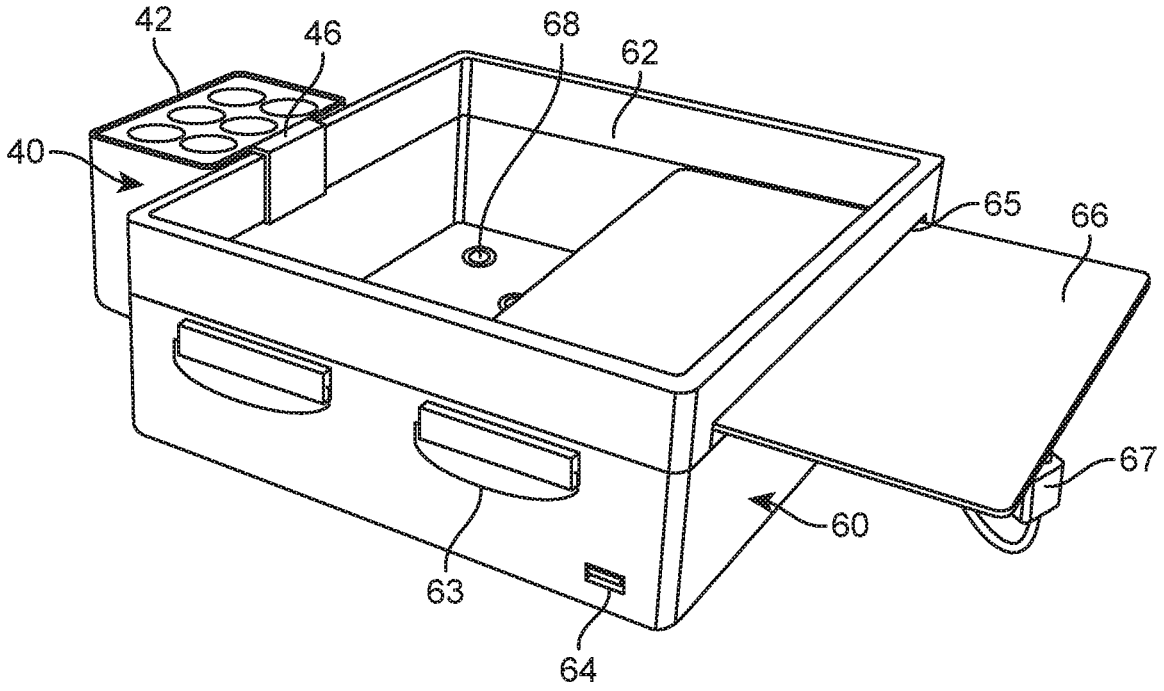
FIG. 6 is a representation of an isometric view of tabletop device assembly 60 having a retractable tray 66 in accordance to an embodiment of the present invention.

Referring now to the drawings, where the present invention is generally referred to with numeral 10, it can be observed a spa system 10 that includes a chair attachment assembly 20, a compartment assembly 40, and a tabletop device assembly 60.

Chair attachment assembly 20 includes an attachment member 22 having sidewalls 22A. In the present embodiment, chair attachment assembly 20 is attached to an arm 72 of a chair 70. Attachment member 22 may be an elongated rectangular member that is placed over a top end of arm 72. In one embodiment, attachment member 22 may be made of a strong plastic material or a metal material. Additionally, attachment member 22 may only partially extend a top end of arm 72. In other embodiments, attachment member 22 may extend the entire top end of arm 72. Sidewalls 22A extend along the sides of attachment member 22 to then receive the sides of arm 72. In one embodiment, sidewalls 22A are snap on sidewalls that receive arm 72 to create a secure attachment. Furthermore, attachment member may be removably attachable to arm 72 through a snap on configuration.

Attachment member 22 includes a bowl member 24 mounted to a furthest most end of attachment member 22. In one embodiment, bowl member 24 may be a substantially semi-spherical member that is integral to attachment member 22. Additionally, bowl member 24 may be mounted in a configuration such that a top end of the bowl member 24 is flush with the top end of attachment member 22. Bowl member 24 is configured to receive water to be used by a user during a spa treatment. In one embodiment, bowl member 24 is of dimensions suitable for a user to place their entire hand therein. Bowl member 24 may also include water jets 26 therein to provide an additional jet option for a user receiving a spa. Water jets 26 may be any suitable jet configuration that expels water at a certain pressure. In one embodiment, water jets 26 are located within an inner bottom end of bowl member 24. In another embodiment of the present invention, water jets 26 may be omitted completely. Furthermore, water jets 26 may be powered by a motor 27 provided as an integral component of bowl member 24. Bowl member 24 further includes a power plug 28 located on a bottom end that is used to power motor 27. Chair attachment assembly 20 provides a user with a convenient and portable device to aid in receiving a manicure treatment. Additionally, the chair attachment assembly 20 allows for a user to submerge their entire hand within the bowl member 24 to aid in the softening of the cuticles.

Compartment assembly 40 includes a compartment 42 having a lid 44 that is configured to be mounted onto the chair attachment assembly 20. In one embodiment, compartment 42 is a cubic rectangular shape and lid 44 is of a hinged type. Compartment 42 is configured to hold manicure utensils 48 such as nail polish and clippers to aid a user receiving a spa treatment. In one embodiment, lid 44 extends partially along a front end of compartment 42. Furthermore, lid 44 includes a locking member 47 that is used to create a secure lock to compartment 42. Locking member 47 may be an oval shaped locking member. It should be understood, any suitable locking means may be used for locking member 47, this may include locking mechanisms known in the art such as hook and loop fasteners, threaded fasteners, and the like.

Compartment 42 further includes a hook member 46 that is mounted to a back end of compartment 42. In one embodiment, hook member 46 is an elongated metal hook member that receives a top edge of bowl member 24. Furthermore, compartment 42 may be mounted to bowl member 24 such that compartment 24 is located entirely on a front end of bowl member 24. Additionally, hook member 46 may partially extend within an inner portion of bowl member 24. Compartment assembly 40 may be removably mounted or provided as an integral attachment to either arm attachment assembly 20 or tabletop device assembly 60. Chair attachment assembly 20 is mounted in a similar configuration to tabletop device 60. Compartment assembly 40 provides a user with the most optimal storage means to hold manicure utensils 48 to aid users receiving a manicure.

Tabletop device assembly 60 includes a receptable 62 that may be rectangular in shape and includes an open top end. Receptable 62 further includes a front-end having arm openings 63 located below a top edge of the front end. It should be understood, arm openings 63 includes two openings, one for each arm of a user respectively. Receptable 62 is configured to hold water therein, a user then places their arms within arm openings 63 and allows the user to submerge their entire hands within the water. In one embodiment, arm openings 63 may be oval or semicircular in shape. However, any shape suitable enough for a user to insert their arms therein may be used. In one embodiment, the front end of receptable 62 may also include a USB port 64 to allow a user to charge a mobile device. In one embodiment, USB port 64 may be located on a bottom right corner of the front end of receptacle 62. Other embodiments may feature USB port located on other locations of receptacle 62.

Receptacle 62 may further include a slot 65 located beneath a top edge of a sidewall of receptacle 62. In one embodiment, slot 65 may be in the from of an elongated rectangular opening. Additionally, slot 65 may be placed a height above arm openings 63. Furthermore, slot 65 receives a tray 66 therein that may cover the entire top end of receptable 62. In one embodiment, tray 66 is of the removable variety. Other embodiments may feature a tray 66 of the hinged variety. In the present embodiment, tray 66 is provided to cover the top end of receptacle 62. Other embodiments may feature tray 66 that only partially covers the top end of receptacle 62. Tray 66 is then slidably received by slot 65 to create a secure attachment thereon. Additionally, tray 66 provides a user with an additional working environment when receiving a manicure treatment. As a result, a user may have their entire hands inserted within arm openings 63 to have their hands completely submerged in water. This practice softens the cuticles to aid in the manicuring process. Once the cuticles have been softened a desired amount, the user may then remove their hands from within the receptacle 62 and place them on top of the tray 66 to then receive a manicure treatment. In one embodiment, tray 66 may partially cover the top end of receptacle 62. With this configuration, a user may observe one of their hands being soaked within the water of receptacle 62 while simultaneously receiving a manicure treatment on the other hand on tray 66.

In one embodiment, receptacle 62 may also feature water jets 68 therein that are powered through power cord 67. In one embodiment, water jets 68 are of the water projecting variety to provide a comfortable sensation to a user's hands. Furthermore, water jets 68 may be located along a bottom end of receptacle 62. Other embodiments may feature water jets 68 located on sidewalls of receptacle 62. Additionally, power cord 67 may be located along a right sidewall of receptacle 62. However, the location of power cord 67 may vary. Additional embodiments may omit the use of water jets 68 and power cord 67. Hand spa system 10 provides a user with the most effective method to receive a manicure for a user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a chair attachment for providing spa treatments, comprising:

a. a chair attachment assembly including an arm attachment member having sidewalls, said arm attachment member is removable attachable to a chair, a bowl member attached to a furthest most end of said arm attachment member, said bowl member including water jets powered by a motor thereon, said bowl member further including a power plug extending from a bottom end of said bowl member; and b. a compartment assembly including a compartment being cubic rectangular in shape and includes a hinged lid, said compartment further including a hook member mounted to a rear end, wherein said hook member attaches to an outer edge of said bowl member.

2. The system for a chair attachment of claim 1 wherein said arm attachment partially extends the length of said arm of said chair.

3. The system for a chair attachment of claim 1 wherein said bowl member includes a top end being flush with a top end of said arm attachment member.

4. The system for a chair attachment of claim 1 wherein said water jets are located on an inner bottom end of said bowl member.

5. The system for a chair attachment of claim 1 wherein said hinged lid extends partially along a front end of said container.

6. The system for a chair attachment of claim 1 wherein said hinged lid includes an oval locking member to create a sealed attachment to said container.

7. The system for a chair attachment of claim 1 wherein said container is located entirely on a front end of said bowl member.

8. The system for a chair attachment of claim 1 wherein said hook member extends partially within an inner portion of said bowl member.

9. The system for a chair attachment of claim 1 wherein said chair attachment holds manicuring tools therein.

* * * * *